US010978223B1

(12) United States Patent
Wrighton

(10) Patent No.: US 10,978,223 B1
(45) Date of Patent: Apr. 13, 2021

(54) GROUND TERMINATION SYSTEM FOR A VARIABLE FREQUENCY DRIVE HARNESS

(71) Applicant: Rolls-Royce Corporation, Indianapolis, IN (US)

(72) Inventor: Steven Wrighton, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 16/584,899

(22) Filed: Sep. 26, 2019

(51) Int. Cl.

| | |
|---|---|
| ***H01R 13/648*** | (2006.01) |
| ***H01B 9/02*** | (2006.01) |
| ***H01R 4/18*** | (2006.01) |
| ***H01R 13/658*** | (2011.01) |
| ***H01R 9/05*** | (2006.01) |
| ***H01R 4/64*** | (2006.01) |

(52) U.S. Cl.
CPC ..... *H01B 9/02* (2013.01); *H01R 4/18* (2013.01); *H01R 4/646* (2013.01); *H01R 9/0512* (2013.01); *H01R 9/0518* (2013.01); *H01R 13/658* (2013.01)

(58) Field of Classification Search
CPC ..... H01B 9/02; H01R 4/646; H01R 13/658; H01R 9/0518; H01R 4/18; H01R 9/0512
USPC ..... 439/108, 95, 607.12
See application file for complete search history.

(56) References Cited

U.S. PATENT DOCUMENTS 3,833,754 A 9/1974 Philibert
3,990,765 A * 11/1976 Hill ..... H01R 4/64 439/607.51
4,191,443 A * 3/1980 Doyle ..... H01R 13/506 439/462
4,738,636 A 4/1988 Bolante
5,342,203 A * 8/1994 Perretta ..... H01R 12/59 439/76.1

(Continued)

FOREIGN PATENT DOCUMENTS

CA 2 568 395 C 3/2010
CN 1 031 7781 1 A 6/2013

(Continued)

OTHER PUBLICATIONS

"StarShield™ Backshell General Information," dated at least as early as Dec. 31, 2012, pp. 1, StarShield™ Zero Length Termination Backshells, Glenair, Inc., Glendale, CA.

(Continued)

*Primary Examiner* — Abdullah A Riyami
*Assistant Examiner* — Nelson R. Burgos-Guntin
(74) *Attorney, Agent, or Firm* — Brinks Gilson & Lione

(57) ABSTRACT

A ground termination system may include a backshell for an electrical connector, a grounding insert and a ferrule. The grounding insert includes an outer peripheral edge and a centrally disposed aperture. The outer peripheral edge may be sized to fixedly engage a surrounding portion of the backshell and the centrally disposed aperture may be defined by a plurality of lobes. A first group of the lobes may be sized to receive power conductors of a variable frequency drive power cable. The ferrule may include a crimp barrel and a sleeve. The crimp barrel may receive a ground conductor and be rigidly clamped thereto. The sleeve of the ferrule may fixedly engage one of the lobes in the second group of lobes and anchor the ferrule in the aperture.

19 Claims, 4 Drawing Sheets

(56) References Cited

U.S. PATENT DOCUMENTS 5,707,252 A * 1/1998 Meszaros ..... H01R 13/508 439/108
6,126,491 A * 10/2000 McCarthy ..... H01R 4/5033 439/695
6,227,881 B1 * 5/2001 Tharp ..... H01R 9/032 174/29
6,386,913 B1 * 5/2002 Mohammad ..... H01R 24/50 439/579
6,533,466 B1 * 3/2003 Smith ..... G02B 6/3817 385/60
6,939,181 B2 * 9/2005 Murphy ..... H01R 13/6592 439/108
7,166,802 B2 1/2007 Cusson et al.
7,304,241 B2 * 12/2007 Trieb ..... H01R 9/032 174/74 R
7,309,835 B2 12/2007 Morrison et al.
7,393,247 B1 * 7/2008 Yu ..... G06F 13/409 439/638
7,942,350 B2 * 5/2011 Shoap ..... F16L 11/12 169/24
8,243,402 B2 8/2012 Benoit et al.
8,753,133 B1 * 6/2014 Errato, Jr. ..... H01R 13/562 439/108
9,490,869 B1 11/2016 Henry et al.
10,096,953 B1 10/2018 Finnestad et al.
10,249,411 B2 * 4/2019 Kunz ..... H01B 11/20
2003/0032336 A1 * 2/2003 Lazaro, Jr. ..... H01R 13/5213 439/680
2003/0148637 A1 * 8/2003 Henry ..... G01V 11/002 439/10
2003/0148672 A1 * 8/2003 Henry ..... G01D 11/245 439/894
2003/0168242 A1 9/2003 Whidden
2006/0105616 A1 * 5/2006 Fisher ..... H01B 9/027 439/465
2007/0141869 A1 * 6/2007 McNeely ..... A47C 31/008 439/76.1
2008/0073102 A1 3/2008 Mueller et al.
2015/0288108 A1 * 10/2015 Fischer ..... H01R 13/652 439/88

FOREIGN PATENT DOCUMENTS

CN 103594190 A 2/2014
CN 105070386 A 11/2015

OTHER PUBLICATIONS

"HexaShield High-Performance EMC/EMI Adapters," dated Apr. 16, 2019, pp. 1-8, TE Connectivity, Brochure No. 2355247-1.

* cited by examiner

GROUND TERMINATION SYSTEM FOR A VARIABLE FREQUENCY DRIVE HARNESS

TECHNICAL FIELD

This disclosure relates to variable frequency drive grounding and, in particular, to ground termination system for a variable frequency drive harness.

BACKGROUND

Variable frequency drive systems can use power electronics as motor drives. These systems may include a harness that includes primary power conductors run co-linearly with one or more ground conductors. The primary power conductors may include one or more cables, such as copper cables, that are twisted together in a bundle. The ground conductors may be bare wires, such as copper cables. The power and ground conductors may be twisted together in a bundle and sheathed within a shield to minimize cable inductance.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Figures 1A, 1B, 1C:
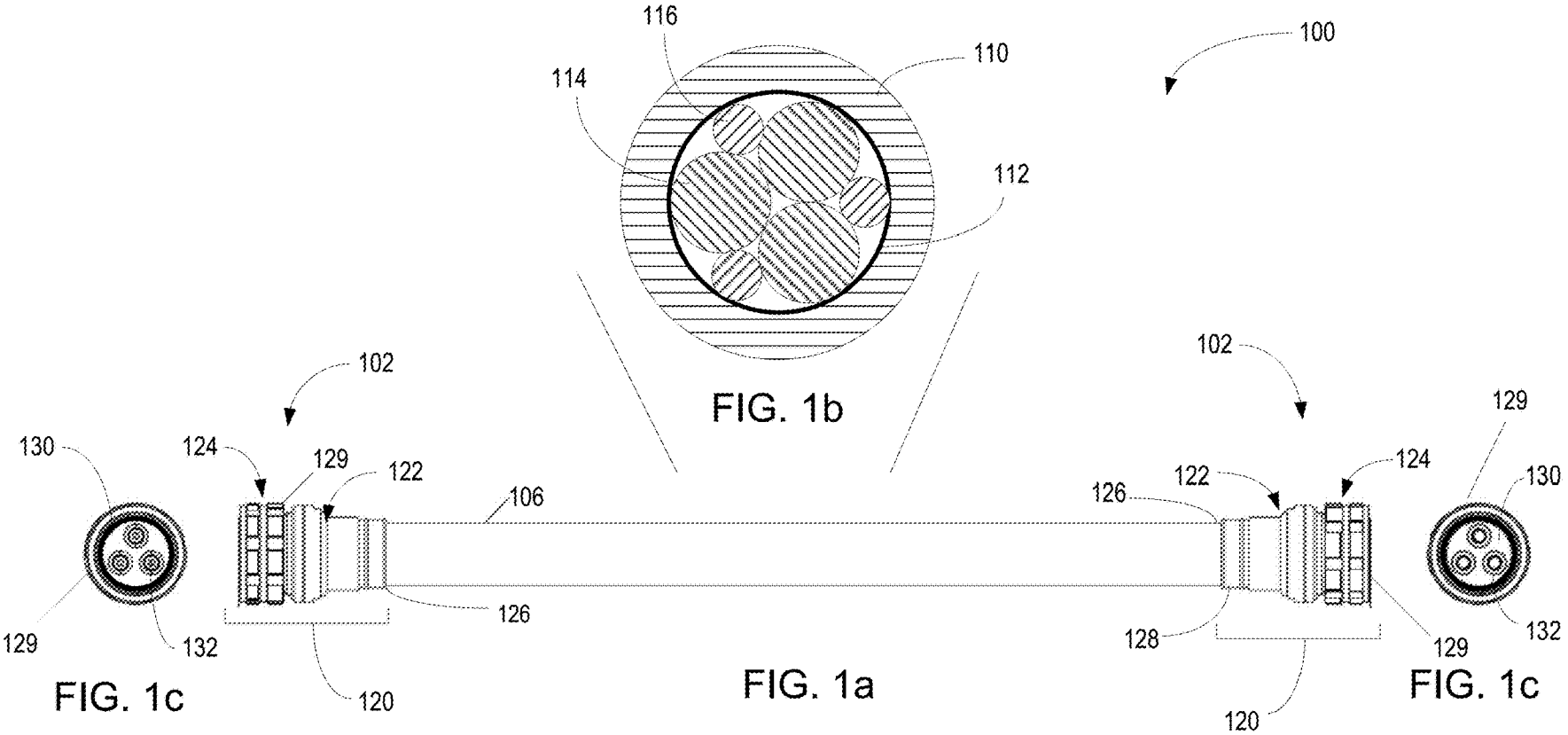
FIGS. 1*a* & 1*b* &1*c* illustrates an example variable speed drive power cable harness that includes a ground termination system.

A ground termination system may include a connector head coupled with a backshell. The connector head may be used to terminate a plurality of variable speed drive power conductors. One or more ferrules included in the ground termination system may terminate one or more ground conductors included with the variable speed drive power conductors. The ground termination system may also include a grounding insert. The grounding insert may engage an interior surface of the backshell. The grounding insert may define power lobe apertures formed to receive and hold, so as to restrain the power conductors within the power lobe, such as to facilitate assembly, respective variable speed drive power conductors passing through the grounding insert. In addition, the grounding insert may define ground lobe apertures formed to receive and fixedly hold the one or more ferrules so as to create an electrically conductive path from the respective ground conductors to the backshell.

In another example, the ground termination system may include a grounding insert having a body and a peripheral edge. The body of the grounding insert may be electrically conductive and formed as a circular planar disk defining a central aperture that includes power lobe apertures and ground lobe apertures. The peripheral edge of the circular planar disk may be a predetermined diameter so as to contiguously contact at least a portion of a backshell of an electrical connector and be fixedly coupled thereto. The ground termination system may also include a plurality of ferrules each being electrically conductive and configured to engage the grounding insert within a respective one of the ground lobe apertures. Each of the ferrules may be electrically conductive and provide termination of a ground conductor such that a ground path through the grounding insert to the backshell is established. A plurality of variable speed drive power conductors may each extend through a respective one of the power lobe apertures for termination.

A variable frequency drive harness may be used to conduct power between a variable frequency drive (VFD) and a variable speed motor. It is important that a shield and ground conductors, such as bare copper ground conductors, included in the harness are connected to a ground plane with as low potential as possible. The ground termination system disclosed herein provides a novel solution for connection of the ground conductors to the backshell to facilitate a low potential ground connection.

An interesting feature of the ground termination system is the grounding insert, which may be an electrically conducting insert, such as a metallic insert, positioned in a backshell of an electrical connector assembly. The metallic insert may include cut-outs, or apertures, for three relatively large, primary power conductors and relatively smaller cutouts for ground conductors.

Another interesting feature of the ground termination system is that the grounding insert may be electrically coupled with the backshell through an interference fit, anti-rotation features, or other locking features to create a conductive path to ground.

Yet another interesting feature of the ground termination system is a ferrule used to electrically connect a respective ground conductor to the grounding insert. The ground conductor may be inserted into one end of the ferrule and then be crimped to maintain a low potential ground conductor to ferrule electrical connection.

Still another interesting feature of the ground termination system is that the ferrule includes a slot cut out that allows an end of the ferrule to be flexible so that the ferrule may be 'snapped in' and retained in a respective ground aperture included in the grounding insert within the backshell.

FIGS. 1*a* & 1*b* &1*c* illustrate an example variable speed drive power cable harness that includes a ground termination system 100. In FIG. 1*a*, the harness includes a variable frequency drive (VFD) power cable 106 extending between a first electrical connector assembly 102 and a second electrical connector assembly 102. Each of the electrical connector assemblies 102 may be a plug or a receptacle connector for electrical and mechanical connection to a corresponding plug or receptacle mating electrical connector. The plug or receptacle may intermate by way of pin or socket contacts. The mating electrical connector may be electrically connected with ground potential through a low impedance ground path. For example, the electrical connector assemblies 102 may be electrical and mechanical connected to a corresponding plug or receptacle mating electrical connector by threaded connection, snap fit, twist-lock, friction fit, or other system to create a detachable electrically conductive coupling therebetween.

The first electrical connector assembly 102 may be electrically coupled with a source of variable frequency power, such as power electronics operable as a VFD or a variable speed drive (VSD) and the second electrical connector assembly 102 may be electrically coupled with a motor, such as an alternating current electric motor to supply power to and/or provide propulsion of, an aircraft. The speed and the torque of the motor may be controlled by variations in frequency and voltage supplied by the VFD via the VFD cable harness.

Examples of aircraft that may use a VFD driven electric motor include a helicopter, an airplane, an unmanned space vehicle, a fixed wing vehicle, a variable wing vehicle, a rotary wing vehicle, an unmanned combat aerial vehicle, a tailless aircraft, a hover craft, and any other airborne and/or extraterrestrial (spacecraft) vehicle. Alternatively or in addition, the VFD and motor may be utilized in a configuration unrelated to an aircraft such as, for example, an industrial application, an energy application, a power plant, a pumping set, a marine application (for example, for naval propulsion), a weapon system, a security system, a perimeter defense or security system. In aircraft applications, the motor may cooperatively operate with a gas turbine engine. Such cooperative operation may be as an alternative or a supplement supply of power or thrust. The gas turbine engine may take a variety of forms in various embodiments, such as a turboprop, a turbofan, or a turboshaft engine.

FIG. 1*b* illustrates a cross-section of a VFD power cable 106 included in the harness. The VFD power cable 106 includes an outer cover or jacket 110 made of a protective insulating material such as silicone or polytetrafluoroethylene (PTFE) surrounding at least one shield 112, such as a braided metal shield or other conductive material. In other examples, the outer cover 110 may be made of other insulating and/or protective materials such as fluorinated ethylene propylene (FEP) and the shield 112 may be other conductive materials, such as a foil. Surrounded by the shield 112 are power conductors 114 and ground conductors 116. In the illustrated example, there are three power conductors 114 capable of providing three phase AC power and three corresponding ground conductors 116 each providing a ground path. In other examples, other numbers of power conductors 114 and/or ground conductors 116 may be surrounded with one or more of the shields 112.

Electrical systems that use power electronics as motor drives may use a VFD power cable harness that includes the ground termination system 100. In such a harness, the ground conductors 116 may be bare copper conductors that lie in parallel with the primary power conductors 114. In other examples, the ground conductors 116 may be insulated with a protective jacket. In the example harness illustrated in FIG. 1*b*, the power conductors 114 and ground conductors 116 are twisted together in a tight bundle with the intention of minimizing cable inductance. The ground conductors 116 may reduce inductance as well as provide a low-impedance path for any ground or common-mode currents.

Referring to FIG. 1*a*, each of the electrical connector assemblies 102 include a backshell 120 having a cable entry section 122 and a connector section 124. The backshell 120 may be an electrically conductive housing formed of a rigid material, such as metal. The housing of the backshell 120 may be formed as circular, oval, square, rectangular or other shape to provide an internal cavity into which the VFD power cable 106 extends. In the illustrated example, the backshell 120 is a generally conical housing having a frustoconical shape. The cable entry section 122 of the backshell 120 includes an aperture that receives the VFD power cable 106, and a banding groove 126, which may be part of the backshell 120.

The banding groove 126 may be a channel formed in the outer circumferential surface or an inner circumferential surface of the backshell 120 to receive a conductive shield band 128. The shield 112 may be electrically coupled with the surface of the backshell 120 to provide a path to ground for the ground termination system 100. In an example, the shield 112 may be positioned to surround the banding groove 126 and a portion of the backshell 120, and an inner surface of a conductive shield band may be placed in contiguous contact with an outer surface of the shield 112 to create electrical coupling of the shield 112 to the backshell 120 in the banding groove 126. In an example, the conductive shield band 128 may be a compressible collar surrounding and electrically coupled with the backshell 120 and the shield 112 may be mechanically compressed into the banding groove 126. In alternative examples, the banding groove may be a channel formed in an internal surface within the backshell 120, and an internal shield ring may be used to electrically couple the shield 112 with the backshell 120 by compressing the shield 112 between an outer surface of the internal shield ring, and the banding groove formed in the internal surface of the backshell 120.

The connector section 124 of the ground termination system 100 may include a connector 129 which is a plug or receptacle used to mechanically couple the VFD power cable harness with a corresponding plug or receptacle connector designed to be mated with the plug or receptacle connector 129 included in the connector section 124. The corresponding plug or receptacle connector may be electrically coupled with other structures or devices such as power electronics or a motor. Accordingly, the coupling side of the plug or receptacle connector 129 included in the connector section 124 may include coupling means such as threads, snap fit, friction fit or some other form of coupling system used to fixedly and detachably electrically couple the VFD power cable harness to a corresponding plug or receptacle connector.

FIG. 1*c* is an end view of the electrical connector assemblies 102. As illustrated in FIG. 1*c*, the electrical connector assemblies 102 may include a connector insert 130 that is disposed in the plug or receptacle connector included in the connector section 124 of the electrical connector assemblies 102. The backshell 120 is a rear accessory that is connected or coupled with the plug or receptacle connector 129 included in the connector section 124 by a coupling ring, fasteners, snap fit, compression fit or other detachable connection system. The power conductors 114 are terminated in the connector insert 130 of the plug or receptacle connector 129 included in the connector section 124. The connector insert 130 may include connector contacts such as lugs, pins or sockets 132. The connector contacts 132 may provide one of a pin or socket connection to another plug or receptacle connector having the other of one of a pin or socket connection. The power conductors 114 may be terminated in contacts such as lugs, pins or sockets 132 by welding, soldering, brazing, crimping, compressing or another form of rigid coupling that forms an electrically conductive connection between the contacts 132 and the power conductors 114.

Figure 2:
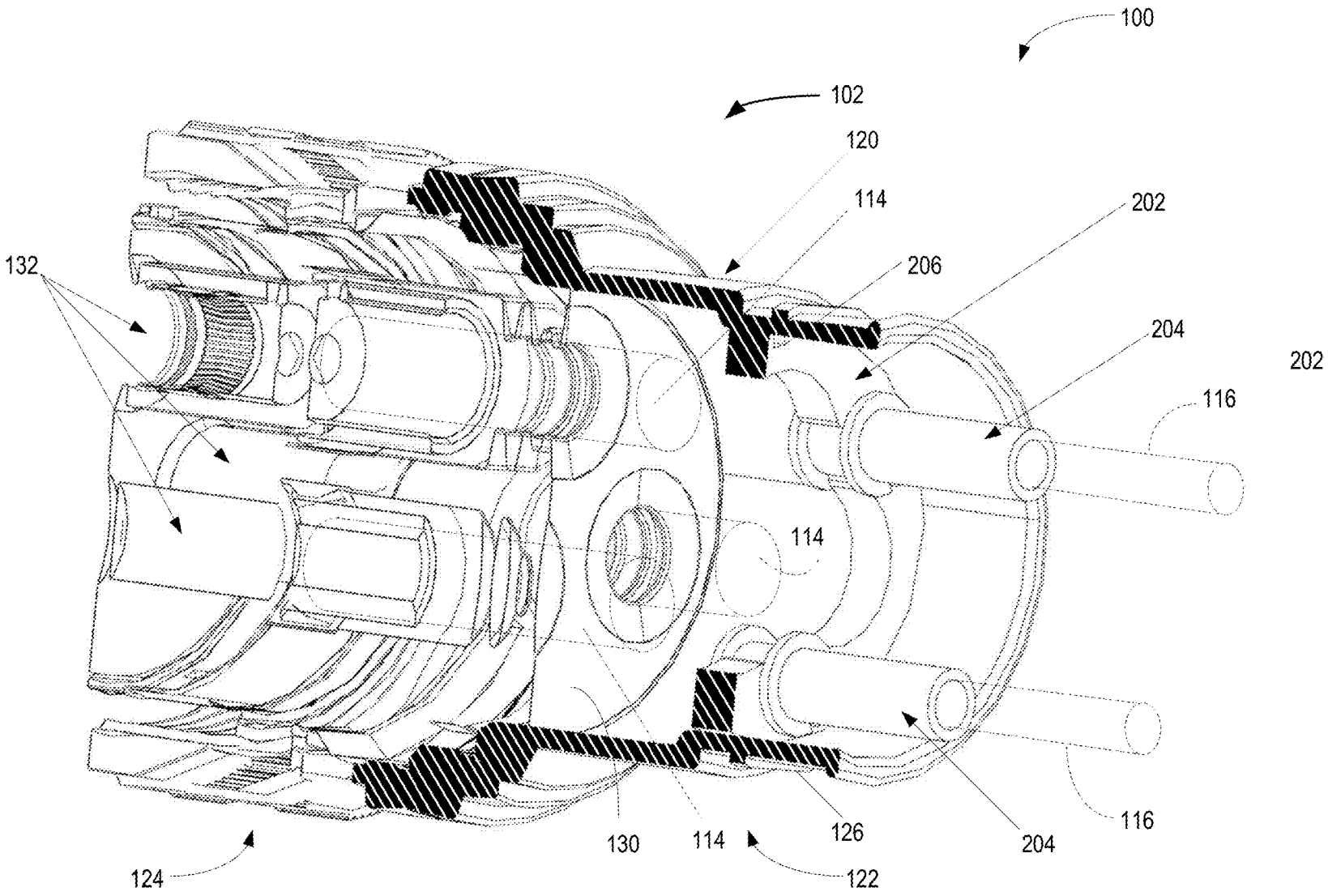
FIG. 2 is a cut-away perspective view of an example electrical connector assembly that includes the ground termination system.

FIG. 2 is a cut-away perspective view of an example electrical connector assembly 102 that includes the ground termination system 100. The electrical connector assembly 102 includes the backshell 120 having the cable entry section 122, which receives the VFD power cable 106 (FIG. 1), and the plug or receptacle connector 129 in the connector section 124 which receives the connector insert 130 in which the power conductors 114 (shown as dotted lines for clarity) are terminated in the contacts 132. In the illustrated example, the power conductors 114 are terminated in the contacts 132 in the connector insert 130 by compression. In other examples, the power conductors 114 may be electrically coupled by friction, bolting, welding, or other means to fixedly and electrically couple each of the power conductors 114 to a respective one of the contacts 132. The backshell 120 also includes a grounding insert 202.

Figure 3:
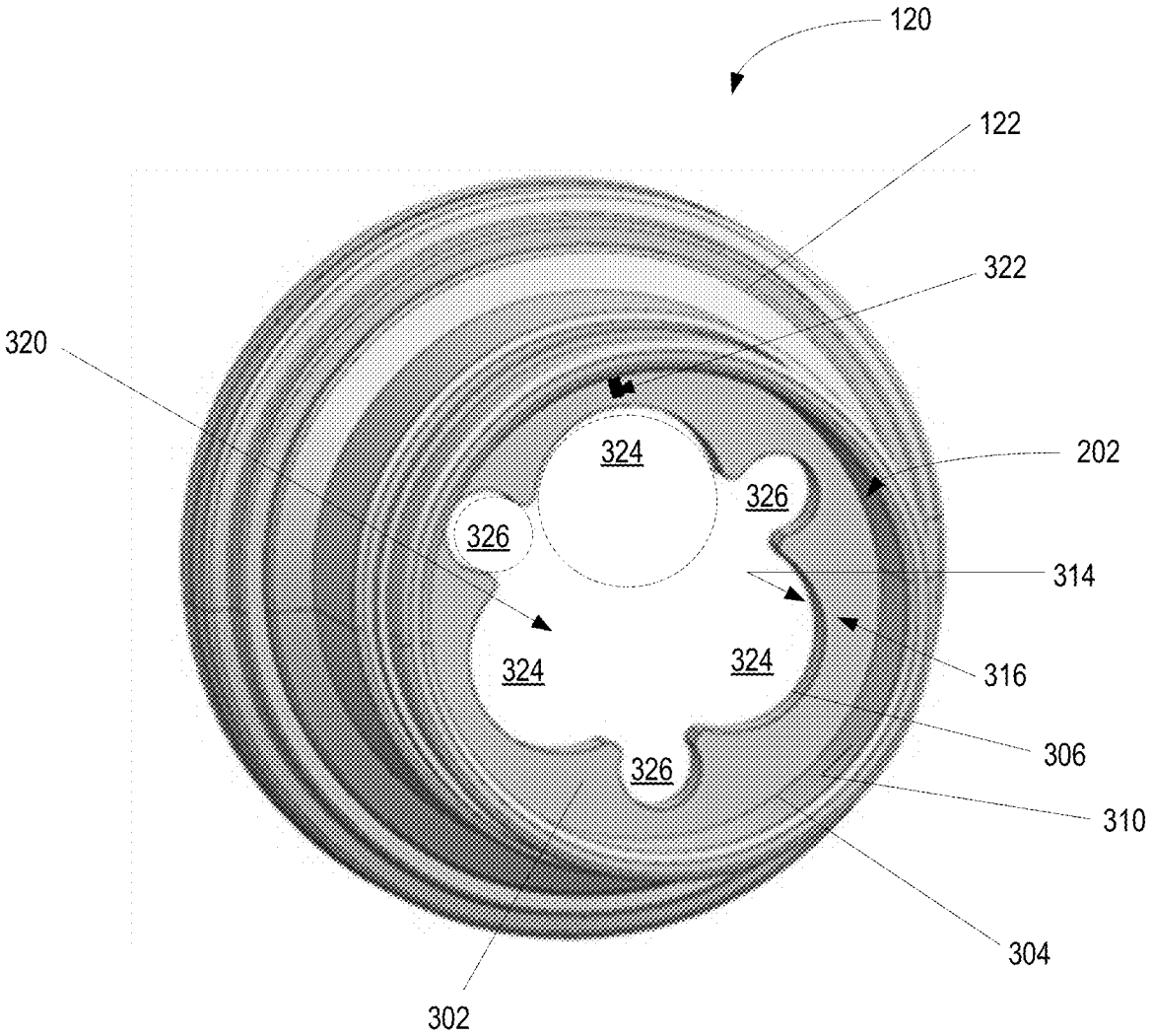
FIG. 3 is a perspective view of a conductor receiving portion of a backshell included in the ground termination system.

FIG. 3 is a perspective view of the cable entry section 122 of the backshell 120. The illustrated cable entry section 122 includes the grounding insert 202 The grounding insert 202 includes a body 302 having an outer peripheral edge 304 and an inner peripheral edge 306. The outer peripheral edge 304 is sized to fixedly engage a surrounding inner wall portion 310 of the backshell 120. In examples, the grounding insert 202 may be press fit or thermal fit into the surrounding inner wall portion 310 of the backshell 120 such that the outer peripheral edge abuts the inner wall portion 310. The grounding insert 202 includes a first planar surface 314 and a second planar surface 316 opposite the first planar surface 314. The outer peripheral edge 304 surrounds both the first planar surface 314 and the second planar surface 316. The peripheral edge 304 may engage at least a portion of the surrounding inner wall portion 310 of the backshell 120. In the illustrated example, the body 302 of the grounding insert 202 is a circular planar disk, defined by the first and second planar surfaces 314 and 316. The circular planar disk has a predetermined diameter defined by the outer peripheral edge 304 so as to contiguously contact and fixedly couple with at least a portion of the backshell 120.

The inner peripheral edge 306 defines a centrally disposed aperture 320 in the ground insert 202. The centrally disposed aperture 320 is a common aperture, which includes a plurality of lobes, or lobe apertures, defined by the inner peripheral edge 306 of the body 302. The central aperture 320 may centrally disposed by being spaced away from the surrounding inner wall portion 310 of the backshell 120 and need not be axially aligned or centered in the grounding insert 202. A first group of lobes are power lobes 324 sized to receive the power conductors 114 of a variable frequency drive power cable 106 (FIG. 1). In an example, each of the power lobes 324 are sized to restrain a respective power conductor 114 included in the variable frequency drive power cable 106. A second group of lobes are ground lobes 326 sized to receive the ground conductors 116 of the variable frequency drive power cable 106 (FIG. 1).

The first group of lobes 324 may be formed by the inner peripheral edge 306 as circular apertures with a diameter proportional to a diameter of the power conductors 114. For example, the power lobes 324 may be sized to receive a predetermined american wire cage (AWG) power conductors.

The power conductors 114 pass through the grounding insert 202 and are terminated in the contacts 132 in the connector insert 130 as part of the plug or receptacle connector 124. In an example, each of the power conductors 114 may include a non-conducting outer jacket, and the power lobes 324 are sized with a predetermined diameter to receive and restrain a power conductor 114 from movement by contiguous contact between the outer jacket of the power conductor 114 and the grounding insert 202 within a respective power lobe 324.

Referring to FIGS. 2 and 3, the second group of lobes 326 may be formed by the inner peripheral edge 306 as circular apertures with a diameter corresponding to the diameter of a ferrule 204. Each of the ground conductors 116 may be terminated in a respective one of the ferrules 204. In the illustrated examples, three ground lobes 326 are included in the grounding insert 202 to engage and electrically conduct with three respective ground conductors 116. In other examples, other numbers of ground lobes 326 and corresponding ferrules 204 may be used in accordance with the number of ground conductors 116 included in the harness.

The power lobes 324 and the ground lobes 326 may be formed in the body 302 in positions corresponding to the positions of the power conductors 114 and the ground conductors 116 in the VFD power cable 106. In the example of FIG. 3, the power lobes 324 include three power lobe apertures 324 symmetrically formed in the grounding insert 202, and the ground lobes 326 include three ground lobe apertures 326 symmetrically formed in the ground insert 202 between the power lobe apertures 324. The power lobes 324 and the ground lobes 326 may each define a portion of the common aperture 320 included in the grounding insert 202. Each of the power conductors 114 may be restrained in respective power lobes 324 in the first group of lobes to pass through the grounding insert 202 with predefined interstices therebetween, and the ferrules 204 may be sized to fit through a respective interstice and be fixedly held in a respective ground lobe 326 in the second group of lobes formed in the grounding insert 202. In other words, the power lobes 324 restrain the power conductors 114 such that interstices are formed between the power conductors 114. The interstices or gaps are sized to accommodate the ferrules 204, such that the ferrules 204 may pass between the power conductors 114 and be positioned in the ground lobes 326.

The body 302 of the grounding insert 202 may be keyed for receipt into the surrounding backshell 120 in a predetermined orientation. For example, one of the backshell 120 and the grounding insert 202 may include a slot or keyway 322 corresponding to a rail or key 206 of the backshell 120. Thus, a keyway 322 may be formed in the outer peripheral edge 304 of the grounding insert 202 and a key 206 may be formed in the backshell inner wall 310 of the backshell 120. In other examples, the key 206 may be included in the grounding insert 202, and the slot 322 may be included in the backshell 120. In still other examples, other forms of keyways 322 may be used to establish a predetermined orientation of the grounding insert 202 with respect to the backshell 120.

Each of the ferrules 204 includes a conductor termination section 210 in which a respective ground conductor 116 is terminated, and a coupling section 212 for coupling with the grounding insert 202. The grounding insert 202 and the ferrule 204 are electrically conductive material providing an electrical grounding path for the ground conductor 116 to the backshell 120. In addition, the banding groove 126, shield band 128, and the grounding insert 202 provide an electrically conductive path between the shield 112 and the ground conductors 116.

Figure 4:
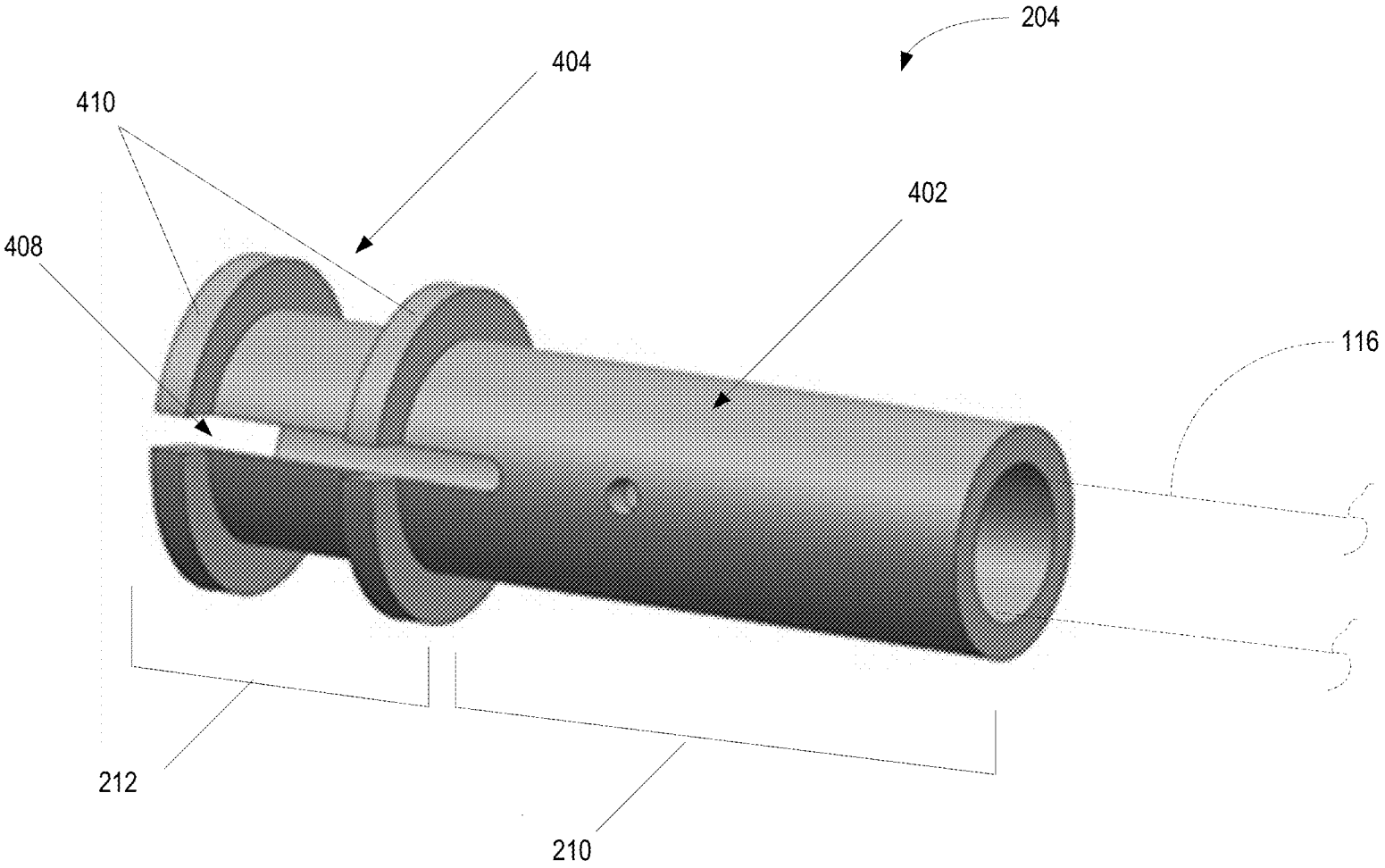
FIG. 4 is a perspective view of an example ferrule included in the ground termination system.

FIG. 4 is a perspective view of an example ferrule 204. The ferrule 204 includes a crimp barrel 402 in the termination section 210 and a sleeve 404 in the coupling section 212. The crimp barrel 402 may receive a ground conductor 116 and be rigidly clamped thereto. In an example, the crimp barrel 402 may be sized as a MIL-DTL-39029 terminal. The sleeve 404 may be inserted into and fixedly engage with one of the ground lobes 326 within the second group of lobes so as to anchor the ferrule 204 in the common aperture 320 as illustrated in FIGS. 2-4.

The sleeve 404 may be formed to include a compressible channel 408 with memory such that the sleeve 404 is inserted into the ground lobe aperture 326 by compressing the channel 408. Upon being fully received in the ground lobe aperture 326, the compressible channel 408 may or may not return to its un-compressed state, due to the memory, such that the ferrule 204 is rigidly held and biased against the portion of the grounding insert 202 defining one of the ground lobe apertures 326 so as to provide a conductive electrical path therebetween.

The sleeve 404 in the coupling section 212 may also include a collar 410 to align the ferrule 204 in the grounding insert 202. In the illustrated example, the sleeve 404 includes opposing collars 410 such that the grounding insert 202 is positioned therebetween when the ferrule 204 is inserted into the ground lobe aperture 326 such that the grounding insert 202 provides an electrically conductive path between the backshell 120 and the ground conductor 116. Accordingly, the collars 410 of this example may form opposing flanges positioned adjacent the respective opposing first and second planar surfaces 314 and 316 of the grounding insert 202 when the ferrule 204 is installed in a respective ground lobe aperture 326.

The ground termination system described herein provides an efficient and effective path to ground for both ground conductors and a shield included in a VFD power cable harness. Thus, low impedance ground potential may be established and maintained uniformly and consistently in a variety of different installations and configurations. In addition, the ground termination system provides a robust and yet compact ground path for VFD cable harnesses. This may be advantageous in applications such as aircraft where minimization of physical footprint is important. By avoiding external cabling and terminations, efficiency of installation and maintenance may also be optimized. Further, in addition to reduction in form factor, minimization of weight is also an important design parameter in aircraft hardware. The compact and efficient use of materials within the ground termination system to provide the low impedance ground path achieves the desired low potential within a relatively lightweight hardware structure.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

1. A ground termination system comprising:

a backshell for an electrical connector;

a grounding insert having an outer peripheral edge and a centrally disposed aperture, the outer peripheral edge sized to fixedly engage a surrounding portion of the backshell and the centrally disposed aperture defined by a plurality of lobes, a first group of lobes sized to receive power conductors of a variable frequency drive power cable; and a ferrule comprising a crimp barrel and a sleeve, the crimp barrel configured to receive a ground conductor and be rigidly clamped thereto, the sleeve configured to fixedly engage one of the lobes in a second group of lobes and anchor the ferrule in the centrally disposed aperture.

2. The ground termination system of aspect 1, wherein the grounding insert and the ferrule are electrically conductive material providing an electrical grounding path for the ground conductor to the backshell.

3. The ground termination system of aspect 1 or 2, wherein the first group of lobes are a plurality of power lobes each configured to receive a respective power conductor included in the variable frequency drive power cable, and the second group of lobes are a plurality of ground lobes each configured to frictionally engage the sleeve of the ferrule.

4. The ground termination system as in any of aspects 1-3, wherein the ground conductor ends in the ferrule at the grounding insert, and the power conductors pass through the grounding insert for coupling with a plug or receptacle connector disposed within and coupled with the backshell.

5. The ground termination system as in any of aspects 1-4, wherein the crimp barrel is sized as a MIL-DTL-39029 type terminal.

6. The ground termination system as in any of aspects 1-5, wherein the grounding insert is press fit or thermal fit into the surround portion of the backshell.

7. The ground termination system as in any of aspects 1-6, wherein an outer periphery of the grounding insert is keyed for receipt into the surrounding portion of the backshell in a predetermined orientation.

8. The ground termination system as in any of aspects 1-7, wherein the backshell is a rear cover configured for connection with a plug or receptacle connector.

9. The ground termination system as in any of aspects 1-8, wherein each of the power conductors are restrained in respective power lobes in the first group of lobes to pass through the grounding insert with predefined interstices therebetween, and the ferrule is sized to fit through a respective interstices and be fixedly held in a respective ground lobe in the second group of lobes formed in the grounding insert.

10. A ground termination system comprising:

a plug or receptacle connector coupled with a backshell, the plug or receptacle connector configured to terminate a plurality of variable speed drive power conductors;

a ferrule configured to terminate a ground conductor included with the variable speed drive power conductors; and a grounding insert configured to engage an interior surface of the backshell, the grounding insert defining a plurality of power lobe apertures formed to receive the variable speed drive power conductors passing through the grounding insert, the grounding insert also defining a plurality of ground lobe apertures formed to receive and fixedly hold the ferrule so as to create an electrically conductive path from the ground conductor to the backshell.

11. The ground termination system of aspect 10, wherein the ferrule includes a sleeve having a compressible channel such that the sleeve is rigidly held and biased against a portion of the grounding insert defining one of the ground lobe apertures so as to provide a conductive electrical path therebetween.

12. The ground termination system of aspect 11, wherein the sleeve includes a collar to align the ferrule in the grounding insert, and the grounding insert provides an electrically conductive path between the backshell and the ground conductor.

13. The ground termination system of aspect 12, wherein the collar includes opposing flanges positioned on opposite sides of the grounding insert when the ferrule is installed in a respective ground lobe aperture.

14. The ground termination system as in any of aspects 10-13, wherein the power lobe apertures include three power lobes symmetrically formed in the grounding insert, and the ground lobe apertures include three ground lobes symmetrically formed in the grounding insert between the power lobes, the power lobes and the ground lobes each defining a portion of a common aperture included in the grounding insert.

15. The ground termination system as in any of aspects 10-14, wherein the grounding insert includes a first planar surface, a second planar surface opposite the first planar surface, and a peripheral edge surrounding both the first planar surface and the second planar surface, the peripheral edge configured to engage at least a portion of an interior portion of the backshell.

16. The ground termination system of aspect 15, wherein the variable speed drive power conductors pass through the grounding insert transverse to the first and second planar surfaces.

17. A ground termination system comprising:

a grounding insert comprising a body and a peripheral edge, the body being electrically conductive and formed as a circular planar disk defining a central aperture that includes a plurality of power lobe apertures and a plurality of ground lobe apertures;

the peripheral edge of the circular planar disk being a predetermined diameter configured to contiguously contact at least a portion of a backshell of an electrical connector and be fixedly coupled thereto; and a plurality of ferrules each being electrically conductive and configured to engage the grounding insert within a respective one of the ground lobe apertures, wherein each of the ferrules is electrically conducting and provides termination of a ground conductor such that a ground path through the grounding insert to the backshell is established, and wherein a plurality of variable speed drive power conductors each extend through a respective one of the power lobe apertures for termination with an electrical connector head of the electrical connector.

18. The ground termination system of aspect 17, wherein the backshell includes a banding groove configured to be surrounded by a shield included with the variable speed drive power conductors, the shield being electrically coupled with the banding groove by a shield band.

19. The ground termination system of aspect 17 or 18, wherein the electrical plug or receptacle connector is configured to couple with the backshell as part of the electrical connector.

20. The ground termination system as in any of aspects 17-19, wherein the variable speed drive conductors are restrained by the power lobes to create interstices between the power conductors which accommodate the ferrules.

In addition to the features mentioned in each of the independent aspects enumerated above, some examples may show, alone or in combination, the optional features mentioned in the dependent aspects and/or as disclosed in the description above and shown in the figures.

What is claimed is:

1. A ground termination system comprising:

a backshell for an electrical connector;

a grounding insert having an outer peripheral edge and a centrally disposed aperture, the outer peripheral edge sized to fixedly engage a surrounding portion of the backshell and the centrally disposed aperture defined by a plurality of lobes, a first group of lobes, the first group of lobes being partial circle apertures sized to receive and removeably retain power conductors of a variable frequency drive power cable extending through the centrally disposed aperture; and a ferrule comprising a crimp barrel and a sleeve, the crimp barrel configured to receive a ground conductor and be rigidly clamped thereto, the sleeve configured to fixedly engage one of the lobes in a second group of lobes being partial circle apertures sized to detachably retain and anchor the ferrule in the centrally disposed aperture.

2. The ground termination system of claim 1, wherein the grounding insert and the ferrule are electrically conductive material providing an electrical grounding path for the ground conductor to the backshell.

3. The ground termination system of claim 1, wherein the first group of lobes are a plurality of power lobes each configured to receive a respective power conductor included in the variable frequency drive power cable, and the second group of lobes are a plurality of ground lobes each configured to frictionally engage the sleeve of the ferrule.

4. The ground termination system of claim 1, wherein the ground conductor ends in the ferrule at the grounding insert, and the power conductors pass through the grounding insert for coupling with a plug or receptacle connector disposed within and coupled with the backshell.

5. The ground termination system of claim 1, wherein the crimp barrel is sized as a MIL-DTL-39029 type terminal.

6. The ground termination system of claim 1, wherein the grounding insert is press fit or thermal fit into the surround portion of the backshell.

7. The ground termination system of claim 1, wherein an outer periphery of the grounding insert is keyed for receipt into the surrounding portion of the backshell in a predetermined orientation.

8. The ground termination system of claim 1, wherein the backshell is a rear cover configured for connection with a plug or receptacle connector.

9. The ground termination system of claim 1, wherein each of the power conductors are restrained in respective power lobes in the first group of lobes to pass through the grounding insert with predefined interstices therebetween, and the ferrule is sized to fit through a respective interstices and be fixedly held in a respective ground lobe in the second group of lobes formed in the grounding insert.

10. A ground termination system comprising:

a plug or receptacle connector coupled with a backshell, the plug or receptacle connector configured to terminate a plurality of variable speed drive power conductors;

a ferrule configured to terminate a ground conductor included with the variable speed drive power conductors wherein the ferrule includes a sleeve having a compressible channel; and a grounding insert configured to engage an interior surface of the backshell, the grounding insert defining a plurality of power lobe apertures formed to receive the variable speed drive power conductors passing through the grounding insert, the grounding insert also defining a plurality of ground lobe apertures formed to receive and fixedly hold the sleeve of the ferrule biased against a portion of the grounding insert defining the ground lobe apertures so as to create an electrically conductive path from the ground conductor to the backshell.

11. The ground termination system of claim 10, wherein the sleeve includes a collar to align the ferrule in the grounding insert, and the grounding insert provides an electrically conductive path between the backshell and a ground conductor.

12. The ground termination system of claim 11, wherein the collar includes opposing flanges positioned on opposite sides of the grounding insert when the ferrule is installed in a respective ground lobe aperture.

13. The ground termination system of claim 10, wherein the power lobe apertures include three power lobes symmetrically formed in the grounding insert, and the ground lobe apertures include three ground lobes symmetrically formed in the grounding insert between the power lobes, the power lobes and the ground lobes each defining a portion of a common aperture included in the grounding insert.

14. The ground termination system of claim 10, wherein the grounding insert includes a first planar surface, a second planar surface opposite the first planar surface, and a peripheral edge surrounding both the first planar surface and the second planar surface, the peripheral edge configured to engage at least a portion of an interior portion of the backshell.

15. The ground termination system of claim 14, wherein the variable speed drive power conductors pass through the grounding insert transverse to the first and second planar surfaces.

16. A ground termination system comprising:

a grounding insert comprising a body and an outer peripheral edge and an inner peripheral edge, the body being electrically conductive and formed as a circular planar disk with the inner peripheral edge defining a central aperture that includes a plurality of power lobe apertures and a plurality of ground lobe apertures, each of the power lobe apertures and the ground lobe apertures being partial circle apertures;

the outer peripheral edge of the circular planar disk being a predetermined diameter configured to contiguously contact at least a portion of a backshell of an electrical connector and be fixedly coupled thereto; and a plurality of ferrules each being electrically conductive and configured to frictionally engage a part of the inner peripheral edge defining one of the partial circle apertures of the grounding insert within a respective one of the ground lobe apertures, wherein each of the ferrules is electrically conducting and provides termination of a ground conductor such that a ground path through the grounding insert to the backshell is established, and wherein a plurality of variable speed drive power conductors each extend through a respective one of the power lobe apertures for termination with an electrical connector head of the electrical connector.

17. The ground termination system of claim 16, wherein the backshell includes a banding groove configured to be surrounded by a shield included with the variable speed drive power conductors, the shield being electrically coupled with the banding groove by a shield band.

18. The ground termination system of claim 16, wherein the electrical plug or receptacle connector is configured to couple with the backshell as part of the electrical connector.

19. The ground termination system of claim 16, wherein the variable speed drive conductors are restrained by the power lobes to create interstices between the power conductors which accommodate the ferrules.

* * * * *